US005429263A

United States Patent [19]

Haubenwallner

[11] Patent Number: 5,429,263

[45] Date of Patent: Jul. 4, 1995

[54] PACKAGE SYSTEM

[76] Inventor: Gerhard Haubenwallner, Griesheimerstrasse 12, A-3370 Ybbs, Austria

[21] Appl. No.: 200,231

[22] Filed: Feb. 23, 1994

[51] Int. Cl.[6] ..... A61J 9/00

[52] U.S. Cl. ..... 220/404; 215/11.3; 215/1 C

[58] Field of Search ..... 220/404, 402, 410, 403; 215/1 C, 11.3

[56] References Cited

U.S. PATENT DOCUMENTS

| | | | |
|---|---|---|---|
| 2,338,604 | 1/1944 | Silveyra | 220/404 X |
| 2,876,113 | 3/1959 | Barton | 220/404 X |
| 2,941,689 | 6/1960 | Black | 220/403 X |
| 3,007,608 | 11/1961 | Cox, Jr. . | |
| 3,117,695 | 1/1964 | Cox, Jr. . | |
| 3,450,254 | 6/1969 | Miles | 220/404 X |
| 3,487,989 | 1/1970 | Rausing et al. | 220/404 X |
| 3,610,455 | 10/1971 | Greenhalgh | 220/404 X |
| 3,776,408 | 12/1973 | Wald | 220/404 X |
| 3,784,039 | 1/1974 | Marco | 215/11.3 |
| 4,330,066 | 5/1982 | Berliner | 220/404 X |
| 4,379,578 | 4/1983 | Schuler . | |
| 4,459,793 | 7/1984 | Zenger | 220/404 X |
| 4,869,912 | 9/1989 | McCoy et al. | 220/404 X |
| 4,919,299 | 4/1990 | Haines | 220/404 |

FOREIGN PATENT DOCUMENTS 0180137 5/1986 European Pat. Off. .

*Primary Examiner*—Steven M. Pollard
*Attorney, Agent, or Firm*—Flynn, Thiel, Boutell & Tanis

[57] ABSTRACT

A package system with substantially reduced weight and volume of the packaging to be disposed of comprises a handling portion (2) and a replaceable bag or similar soft package (1) taken up by the handling portion (2) and holding the contents. The soft package (1) has a ring (10) around an opening (14), and the handling portion (2) a base (5) and an opening (13). When the handling portion (2) takes up the soft package (1) the ring (10) on the opening (14) of the soft package lies on the edge (12) on the opening (13) of the handling portion (2). This fixes the soft package (1) within the handling portion (2). The closure for closing the soft package (1) taken up by the handling portion (2) has a closing member, e.g. a screw cap (16) which, in the closed position, urges the ring (10) on the opening of the soft package (1) against the edge (12) of the opening (13) of the handling portion (2) so that the ring (10) at the same time forms a seal.

16 Claims, 2 Drawing Sheets

FIG. 1
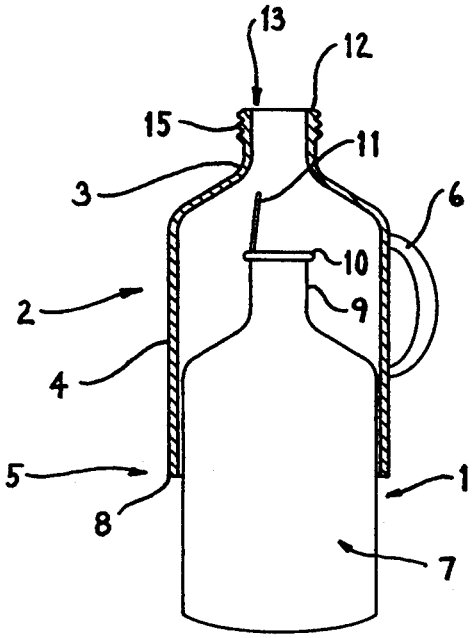
FIG. 2
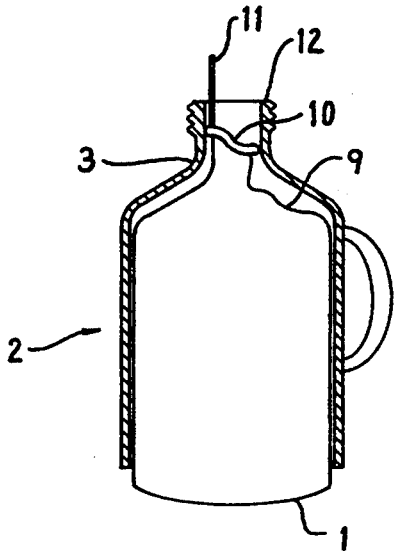
FIG. 3
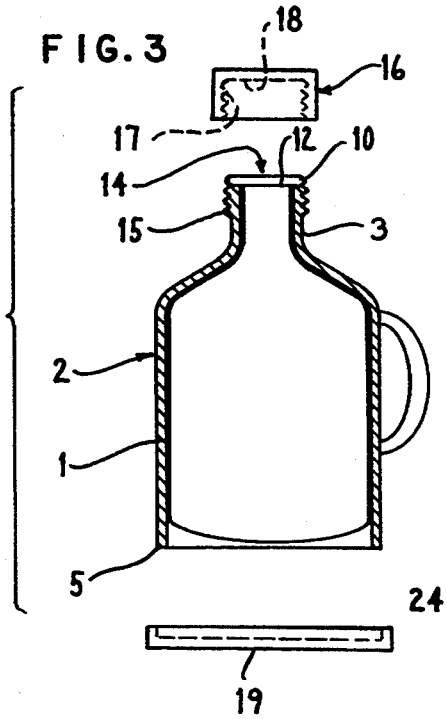
FIG. 4
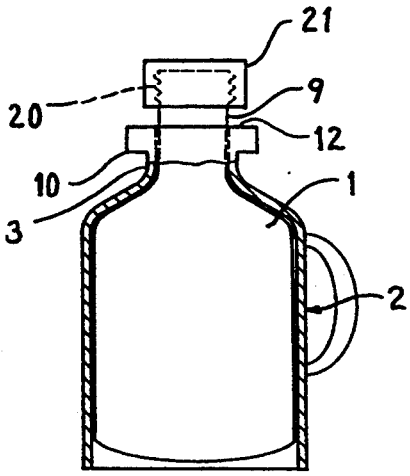
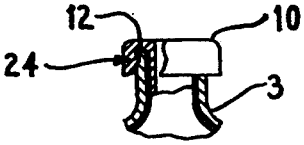
FIG. 6
FIG. 5
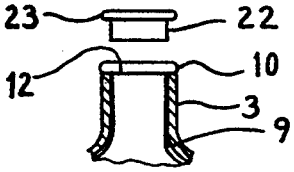

PACKAGE SYSTEM

The present invention relates to a package system according to the preamble of claim 1.

Such a package system known as an "eco light pack" is already used for packaging detergents. The detergent is filled into a thin-walled and thus soft inside container made of plastic having a rectangular cross section and provided with a screw cap. The inside container is surrounded by a rectangular cardboard wrapping that is glued to the soft inside package and forms the handling portion.

This system substantially reduces the proportion of plastic compared to a conventional plastic bottle. It is also possible to dispose of the cardboard and the plastic inside container separately.

However the rectangular carton shape necessitates a relatively large package surface and thus amount of packing material. Also, the inside container must still be made of a relatively thick sheet, not so much because of its package function, i.e. to hold the contents, but rather to support the screw cap mounted on the soft package during opening and closing. The relatively thick packing material of the inside container not only results in corresponding weight, it also limits the compressibility of the inside container in the empty state, i.e. the inside container springs back resulting in a relatively large void volume.

Also, before disposal the carton must be torn open and separated from the glued-on inside container, whereby bits of cardboard and adhesive remain on the inside container rendering a properly sorted reutilization virtually impossible. Furthermore, separate disposal of the cardboard and plastic inside container involves elaborate logistics and the related disadvantages. For example the consumer must put the cardboard and the plastic container in different waste containers, which is a further difficulty and means that lazier, less ecology-minded consumers will not bother with separate disposal.

Packaging regulations are becoming increasingly strict. Under Art. 1 (2) no. 1 of the German Packaging Ordinance of Jun. 12, 1991, the volume and weight of packages must be limited to the extent immediately necessary for protecting the contents and for marketing. Under Art. 6 (2) of the drafted Austrian Packaging Ordinance an obligation to return must fundamentally be provided for packages with a filling volume of 100 ml and more, with the exception of only bags sacks, foil packages and other packages made of sheetlike, flexible packing materials with very low specific weight. One can therefore expect the abovementioned known "eco" package to be likewise subject to an obligation to return very soon.

So-called "bag-in-a-box" package systems are also known that comprise a flexible cuboid plastic container filled with a liquid and disposed in a support carton (cf. e.g. FR-C 2 483 893, U.S. Pat. No. 3,007,608, U.S. Pat. No. 3,117,695 and EP 0 180 137 A2). FR-C 2 476 606 discloses a thermos or similar double-walled bottle wherein the inside bottle, which is within the outside container, protrudes with its neck through an opening in the outside container. On the neck of the inside bottle to be closed with a stopper, there is a screw cap which cooperates with a thread provided on the opening of the outside container. To permit the inside bottle to be put in the outside container the substantially cylindrical outside container comprises two parts which are screwed together. The inside bottle must be made of a robust material to be supported on the bottom.

To permit better handling especially of large bottles, U.S. Pat. No. 4,379,578 discloses providing a handle attached to the neck, on the one hand, and to the body of the bottle, on the other hand.

The invention is based on the problem of providing a package system whereby substantially only one package with considerably reduced package weight and volume need be disposed of.

This is achieved according to the invention by the package system characterized in claim 1. The subclaims state advantageous embodiments of the invention.

In the inventive package system the contents are held in a bag or similar soft package, i.e. in a package made of a light flexible packing material.

The packing material can be e.g. plastic, paper, cardboard, rubber or metal. The package can be produced by welding, blowing or injection molding. The plastic may be virtually any plastic used nowadays for plastic bottles, e.g. polyethylene. The contents can be liquid, paste or powder.

According to the invention the package can be flexible, i.e. in particular a bag, because the package is held or fixed with the ring on its opening on the edge of the opening of the handling portion.

The bag therefore only needs to hold the contents together and delimit them from the surroundings while the other functions of a package, in particular its depositing and the handling of the contents during their use, are performed according to the invention by the handling portion.

Since plastics have high strength, the bag is preferably made of plastic. It can then be particularly light and thin-walled. However, other packing materials are also possible, such as metal foils, rubber or cardboard. If plastic is used, the weight of the package can be reduced to 10 g or less, preferably 5 g or less, per liter of package capacity.

Since the package is flexible and thin-walled it can be reduced to an accordingly small volume in the empty state. That is, the empty bag collapses when taken out of the handling portion, resulting in a much smaller void volume than with known light packages.

The handling portion can have a more expensive or functional design due to its multiusability without substantially increasing the costs per cycle. For example more or less elaborate dosing means, atomizers and similar means can be provided on the handling portion. The handling portion can also have a more elaborate design in terms of its material due to its reusability. It need not be made of plastic but can be made of more expensive materials such as glass, ceramics or metal.

When the package is full and closed it is largely inherently stable due to the contents, i.e. in the filled-up state the package can be labeled, deposited and otherwise handled. The inherent stability in the filled state is ensured by the shape of the package with solid and liquid contents; with solid contents the package can also be suitably shaped after being filled.

Only when the soft or inside package is introduced into the handling portion, opened and emptied does it lose its inherent stability and thus ease of handling; these functions are now performed by the handling portion.

In the inventive package system the ring on the inside package overlaps the edge of the opening provided on the handling portion. The soft inside package thus hangs with its entire weight on the ring or it is supported more or less on the bottom so that the ring takes up only part of the weight of the soft inside package when the handling portion stands upright. The base of the handling portion permits the handling portion to be deposited in stable fashion with the inside package disposed therein.

The ring on the opening of the inside package preferably serves at the same time as a seal ring. For this purpose the opening of the handling portion can be formed by a neck or similar sleeve- or ring-shaped portion. If the closure is a screw closure the thread of the screw closure is preferably provided on the neck. In the closed position the screw cap screwed on this thread then urges the ring against the edge on the opening of the handling portion, thereby sealing off the inside package additionally from the outside.

Instead of a screw closure one can also provide a different type of closure for urging the ring against the edge on the opening of the handling portion for sealing purposes. For example a bayonet socket can be provided with one part being formed by the neck on the handling portion and the other part by a cap which, in the closed position, urges the ring on the inside package against the edge on the opening of the handling portion. It is also possible to use a stopper having at the top a ring-shaped extension, for example, for urging the ring on the inside package against the edge on the opening of the handling portion.

To fix the inside package on the handling portion the ring can also be connected with the bag by a sleeve, whereby the sleeve has an outside diameter corresponding to the inside diameter of the neck to form a wringing fit within the neck. However the fixation can also be provided in a different way, for example by a Velcro closer or a (nonhardening) adhesive bond between the ring and/or the sleeve provided on the ring and the opening or the neck of the handling portion. A sleeve is preferably provided for fixing the inside package, being insertable into the opening of the soft package and the soft package then urged against the handling portion in this area. The fixing sleeve can be provided with a ring shoulder that urges the ring on the opening of the soft package against the edge on the opening of the handling portion when the sleeve is inserted.

The ring is preferably connected integrally with the bag or similar flexible soft container of the inside package. For this purpose the ring can be produced in one piece with the bag or container. However it can also be welded, glued or otherwise connected undetachably to the bag or container.

The ring can be made of the same materials as the packaging of the inside package, e.g. plastic, rubber, cardboard or metal. However a plastic ring is preferable. If the opening or the neck of the handling portion has a smaller diameter than the outside diameter of the inside package, and the ring and packaging of the inside package are integrally formed, the ring must be of flexible design so to be put through the opening or neck.

The inside package to be introduced into the handling portion is normally closed. For this purpose one can provide for example a stopper that is inserted in the ring, but the inside package is preferably sealed at its opening. For sealing one can provide for example a wafer that is welded, glued or otherwise connected to the ring. The wafer can be made of plastic or metal foil or of cardboard. To seal the opening of the inside package, however, the ring can also be compressed and then welded, glued or otherwise closed.

The inside package must in any case be closed in such a way that it can be handled and transported with no problem in the closed state from the filling unit to the user, i.e. until it is introduced into the handling portion.

The inside package is preferably opened only after it has been introduced into the handling portion, i.e. its ring overlaps the edge of the opening of the handling portion.

As mentioned, the ring on the inside package must be put through the opening of the handling portion, in particular if the opening of the handling portion is formed as a neck or similar sleeve- or ring-shaped portion. This can be done by drawing the ring through the opening or the neck of the handling portion. To facilitate this the soft or inside package can have a draw-in aid on its opening, which can be for example a tab fastened to the ring. The draw-in aid is preferably designed so that it at the same time permits the sealed inside package to be opened, i.e. in particular as a tearaway seal. If the seal on the opening of the inside package is formed by a wafer spanning the ring with a tab fastened thereto as a draw-in aid, the tab can at the same time serve to tear away the wafer and thus open the inside package. The draw-in aid need not be a tab, it may also be formed differently, for example as a strip which can be used at the same time as a tear strip for opening the sealed opening of the inside package.

The handling portion of the inventive package system can have very different forms. The essential features are only the opening on the handling portion for holding the ring of the inside package, a base on the handling portion, and means permitting easy handling of the handling portion, i.e. a handle or the like.

That is, the handling portion need not have a closed periphery but can for example be open on the side; the base can be formed as a ring, etc. The handling portion thus only needs to surround the soft inside package as far as is necessary for its handling.

The inside package can be brought together with the handling portion from above, below or the side.

However the handling portion preferably has the shape of a bottle, for example a plastic bottle with a handle as is commonly used nowadays for a great variety of domestic liquid cleaning agents.

Such a bottle need only be slightly modified to be used as a handling portion in the inventive package system. That is, the bottle need only be modified so that the inside package can be introduced into it.

This can be done by providing an opening in the bottle, for example on the bottom by omitting the bottom of the bottle or by forming the bottom of the bottle as a lid.

However the bottle can also be formed in a different way to be opened and thus permit introduction of the inside package, for example have two or more parts, e.g. a bipartite longitudinally cut formation whereby the two parts can be swung apart.

Since only relatively slight modifications of existing bottles are thus required, for example omitting the bottom, all the other existing parts and means for bottle production, in particular for producing plastic bottles, can be taken over largely unchanged, for example the screw cap.

When the inside package has been introduced into the bottle-shaped handling portion the latter is expediently closed so tight that when the side walls of the bottle-shaped handling portion are pressed together a pressure is exerted on the inside package, pressing out its contents.

The inside package is of course smaller than the bottle-shaped handling portion so that it can be introduced into the bottle-shaped handling portion. Apart from this, however, the shape and size of the inside package and the bottle-shaped handling portion are preferably adapted to each other to a large extent. That is, for a bottle-shaped handling portion with an oval cross section one preferably provides an inside package with the same bottle shape and the same oval cross section. However the shape and size of the handling portion and inside package are preferably formed differently for the individual materials to be held. That is, a handling portion intended for certain contents in terms of its getup, in particular its inscription, and the inside package are coordinated with each other in shape and size so that an inside package with different contents will not fit into the handling portion. This ensures that only an inside package with the right contents fits into a certain handling portion, thus excluding confusion of contents.

For this reason, but also to prevent inside package and handling portion from rotating mutually during opening and closing, the bottle-shaped handling portion is preferably non-cylindrical, i.e. for example oval or polygonal.

In the following some embodiments of the inventive package system will be explained in more detail with reference to the schematic drawing, in which:

FIGS. 1 to 3 show a longitudinal section of the package in an embodiment of the invention for introducing a soft package into a handling portion;

FIG. 4 shows a longitudinal section through a soft package taken up by a handling portion in another embodiment of the invention;

FIG. 5 shows a longitudinal section through the neck of the handling portion with a fixing sleeve;

FIG. 6 shows a variant of the ring on the opening of the soft package;

Figure 7:
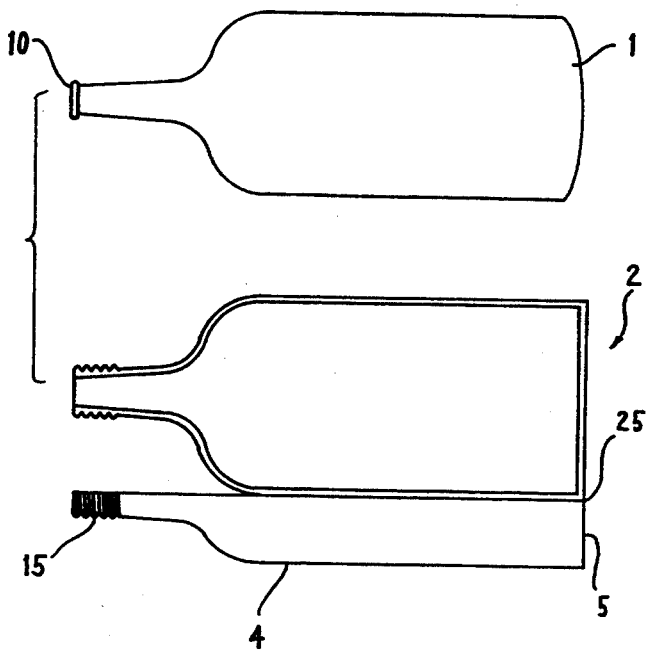
FIG. 7 shows a side view of the soft package and the swung-open handling portion in a further embodiment of the invention.

According to FIGS. 1 to 3 soft or inside package 1 is introduced into handling portion 2. Soft package 1 is formed by a bag and is cram-full with its contents. Handling portion 2 is bottle-shaped, i.e. it has neck 3 at the top, body portion 4 and bottom portion 5. Handle 6 is fastened to body portion 4. Opening 7 extending over almost the total width of the bottom is provided in bottom portion 5 so that edge 8 around opening 7 forms a ring-shaped base on the bottom of handling portion 2.

Soft package 1 is adapted to the shape and size of handling portion 2 but is somewhat shorter than handling portion 2. That is, soft package 1 also has neck portion 9 with ring 10 extending around its end. Ring 10 is closed e.g. by a foil not shown in the drawing. A tab or the like formed as draw-in aid 11 is fastened to ring 10.

Draw-in aid 11 is used to draw ring 10, which is of flexible design, through neck 3 of handling portion 2 as shown in FIG. 2. Draw-in aid 11 is mounted laterally on ring 10 so that ring 10 is more easily deformed and can thus be drawn easily through neck 3 of handling portion 2. When ring 10 has been drawn through neck 3 it lies on edge 12 which extends around opening 13 of neck 3 of handling portion 2.

Draw-in aid 11 is then removed, for example torn off. This at the same time tears off or open the abovementioned foil on ring 10 so as to form opening 14 on soft package 1. Since package 1 is shorter than handling portion 2 it hangs with ring 10 on edge 12 of neck 3 of handling portion 2 when handling portion 2 stands upright. However the soft package can also be flush with edge 8 but must not protrude beyond edge 8 of bottom portion 5 of handling portion 2 since this would destroy the stability of handling portion 2.

Neck 3 of handling portion 2 is provided with external thread 15 on which screw cap 16 with internal thread 17 can be screwed for closing opening 14 of soft package 1. When screw cap 16 is screwed on external thread 15 and located in its closed position it urges with its bottom 18 ring 10 against edge 12 on opening 13 of neck 3 of handling portion 2 so that ring 10 at the same time forms a seal. Opening 7 in bottom portion 5 can be closed by lid 19. This seals off the interior space of handling portion 2 from the outside. When handling portion 2 is then compressed in the area of body portion 4 a pressure is exerted on soft package 1 which presses out the contents in soft package 1.

In the embodiment of FIGS. 1 to 3 soft package 1 is thus closed by a screw closure composed of external thread 15 on neck 3 of handling portion 2 and screw cap 16. No thread is provided on neck 9 of soft package 1 however. This reduces the production cost for soft package 1, on the one hand, and permits neck 9 of soft package 1 to be just as flexible as the rest of the bag, on the other. That is, neck 9 is virtually irrelevant during disposal in terms of its weight and volume.

This advantage is not realized in the embodiment of FIG. 4. Here, external thread 20 is provided on neck 9 of soft package 1. External thread 20 receives, on the one hand, ring 10 supporting soft package 1 on edge 12 of neck 3 of handling portion 2 and, on the other hand, screw cap 21 on the part of external thread 20 protruding out of ring 10.

The embodiment of FIG. 5 differs from that in FIGS. 1 to 3 substantially in that sleeve 22 is provided for fixing ring 10 when soft package 1 hangs within handling portion 2, e.g. after the screw cap is opened, sleeve 22 urging soft package 1 against neck 3 of handling portion 2 in the area of neck 9. Fixing sleeve 22 has ring-shaped extension 23 for urging ring 10 against edge 12 of neck opening 13 when sleeve 22 is inserted in neck 3 of soft package 1.

In the variant of FIG. 6 ring 10 overlaps edge 12 of neck 3 of handling portion 2. On the outside of neck 3 or edge 10 one can provide mutually cooperating projections and recesses so as to form catch 24 which fixes ring 10. This embodiment is intended in particular for soft packages that are suitable for insertion due to their inherent stability. Draw-in aid 11 can then be omitted.

Figure 8:
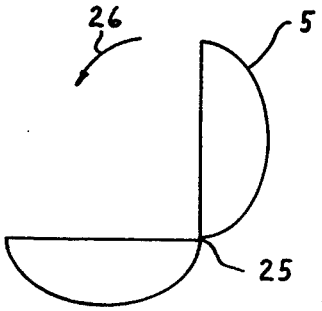
FIG. 8 shows a view of the bottom of the swung-open handling portion of FIG. 7.

According to FIGS. 7 and 8 soft package 1 is put in swing-open handling portion 2. For this purpose handling portion 2 is divided longitudinally except for hinge 25 on body portion 4 but including external thread 15 and bottom portion 5. If handling portion 2 is formed by a molded plastic part, hinge 21 can be a sheet hinge.

Figure 9:
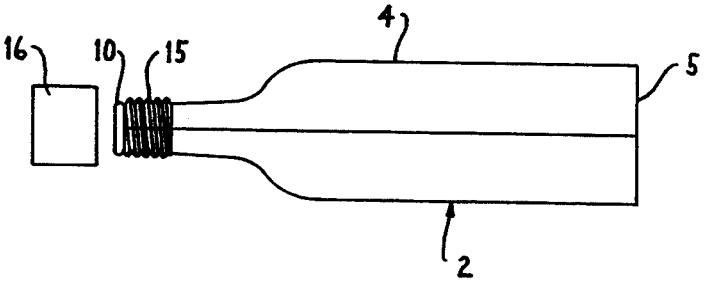
FIG. 9 shows a side view of the closed handling portion in FIGS. 7 and 8.
Figure 10:
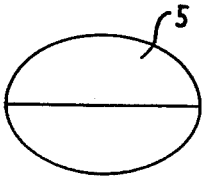
FIG. 10 shows a view of the bottom of the closed handling portion of FIG. 9.

After package 1 is inserted in handling portion 2 the latter is folded up as illustrated in FIG. 8 by arrow 26. A catch or similar closure not shown in the drawing then holds handling portion 2 with soft package 1 disposed therein in the closed position shown in FIGS. 9 and 10. FIGS. 8 and 10 also indicate that handling portion 2 and thus also soft package 1 have an oval cross section in the area of body and bottom portions 4 and 5.

Handling portion and soft package can instead also have a circular, rectangular or prismatic cross section or a different shape.

I claim:

1. A package system comprising: a soft package, a hollow handling portion for receiving and substantially enclosing said soft package and a means for closing said soft package after it has been received by said handling portion, said soft package having an opening at one end thereof and a flexible ring around said opening, said flexible ring being formed integrally with said soft package, said handling portion having a main portion with a first opening provided therein, said handling portion further having an upper portion which is narrower in diameter than said main portion and has an edge defining a second opening, said soft package being received into said handling portion through said first opening in said main portion, said ring of said soft package being drawn through said second opening out of said narrowed upper portion of said handling portion and overlying said edge of said second opening of said handling portion, said edge portion blocking reverse movement of said ring through the second opening back into said handling portion, said means for closing clamping said ring of said soft package against said edge of said upper portion of the handling portion.

2. The package system of claim 1, wherein said means for closing includes a fixing sleeve, insertable in the opening of the soft package, and therewith urging the soft package in the area of its opening against the handling portion.

3. The package system of claim 1, further comprising a removable seal closing the soft package at its opening.

4. The package system of claim 3, further comprising a draw-in aid affixed to the seal at the opening of the soft package for drawing the ring through the second opening in the upper port of the handling portion and for removing the seal.

5. The package system of claim 1, further comprising a draw-in aid, affixed to the soft package at its opening, for drawing the out through the second opening of the upper portion of the handling portion.

6. The package system of claim 1, wherein the second opening at the upper portion of the handling portion is formed by a neck.

7. The package system of claim 1, wherein the means for closing is formed by a screw closure or bayonet socket, the opening of the handling portion forming the thread for the screw closure or one part of the bayonet socket, and the closing member being formed by a cap cooperating with the thread or forming the other part of the bayonet socket.

8. The package system of claim 1, wherein the handling portion has the shape of a bottle.

9. The package system of claim 8, wherein the opening in the main portion of the handling portion is provided on the bottom of the bottle-shaped handling portion.

10. A package system comprising: a soft package, a draw-in aid affixed to said soft package, a handling portion, and a means for closing said soft package after it has been received by said handling portion, said soft package having an opening at one end thereof and a ring around said opening, said handling portion having a bottom portion with an opening provided therein, said handling portion having an upper portion which is narrower in diameter than said bottom portion and has an edge defining a second opening, said soft package being received into said handling portion through said opening in the bottom portion, said ring of said soft package being drawn through said second opening out of said handling portion by pulling said draw-in aid of said soft package out of said handling portion through said second opening and placing said ring of said soft package on said edge of said handling portion, said edge blocking reverse movement of said ring through the second opening back into said handling portion.

11. A package system comprising: a soft package having an opening at one end thereof, a seal over said opening, a draw-in aid affixed to said seal and a ring around said opening, a handling portion for receiving said soft package, said handling portion having a main portion with an opening provided therein and an upper neck portion having an edge defining a second opening, and a means for closing said soft package after it has been received by said handling portion, said soft package being received into said handling portion through said opening in said bottom portion, said ring of said soft package being drawn up through said second opening out of said handling portion by pulling up the draw-in aid of said soft package out through said second opening of said handling portion, said ring of said soft package overlying said edge of said handling portion, said edge blocking reverse movement of said ring through said second opening back into said handling portion.

12. The package system of claim 11, wherein the ring is flexible.

13. The package system of claim 1, wherein the soft package is plastic.

14. The package system of claim 1, said handling portion is an outside container of cardboard.

15. The package system of claim 1 in which said handling portion is reusable and shape retaining, said soft package being prefillable with a pourable material prior to insertion into said handling portion, said soft package being sized to substantially fill said handling portion.

16. The apparatus of claim 1 in which said ring has an outside diameter approximating the outside diameter of said upper portion of said handling portion, said ring outside diameter exceeding the inside diameter of the second opening in said handling portion, said ring being elastically bendable to temporarily reduce its outside diameter in one diametral direction to less than the inside diameter of said second opening in said handling portion, so as to permit said ring to be drawn from the main portion of said handling portion through said upper portion thereof and out through said second opening.

* * * * *

UNITED STATES PATENT AND TRADEMARK OFFICE

CERTIFICATE OF CORRECTION

PATENT NO. : 5 429 263

DATED : July 4, 1995

INVENTOR(S) : Gerhard HAUBENWALLNER

It is certified that error appears in the above-indentified patent and that said Letters Patent is hereby corrected as shown below:

Column 7, line 45; change "port" to ---portion---.

line 49; after "the" (first occurrence) insert ---ring---.

Signed and Sealed this

Seventeenth Day of October, 1995

*Attest:*

*Attesting Officer*

Bruce Lehman

BRUCE LEHMAN

*Commissioner of Patents and Trademarks*